US006378286B2

(12) United States Patent
Vermes et al.

(10) Patent No.: US 6,378,286 B2
(45) Date of Patent: Apr. 30, 2002

(54) LOW NOX GAS TURBINE COMBUSTOR LINER

(75) Inventors: Geza Vermes; George Opdyke, Jr., both of Stratford, CT (US)

(73) Assignee: Power Tech Associates, Inc., Media, PA (US)

( * ) Notice: Subject to any disclaimer, the term of this patent is extended or adjusted under 35 U.S.C. 154(b) by 0 days.

(21) Appl. No.: 09/835,220

(22) Filed: Apr. 13, 2001

Related U.S. Application Data

(62) Division of application No. 08/491,039, filed on Jun. 16, 1995, now abandoned.

(51) Int. Cl.[7] ..... F02C 7/26; B21D 53/00

(52) U.S. Cl. ..... 60/39.06; 60/752; 60/754; 60/755; 29/890.02

(58) Field of Search ..... 60/39.06, 752, 60/754, 755, 757, 748; 29/890.02

(56) References Cited

U.S. PATENT DOCUMENTS

| | | | | |
|---|---|---|---|---|
| 3,490,747 A | | 1/1970 | DeCorso et al. | 415/175 |
| 4,232,527 A | * | 11/1980 | Reider | 60/754 |
| 4,475,344 A | * | 10/1984 | Mumford et al | 60/757 |
| 5,289,686 A | * | 3/1994 | Razdan et al. | 60/755 |
| 5,488,829 A | * | 2/1996 | Southall et al. | 60/725 |

OTHER PUBLICATIONS

Scheirer et al, "NOX Reduction Program for CPP Brush CoGen Facility W251AA Gas Turbines," Proceedings of the American Power Conference, Apr. 27, 1994.

Hilt et al, "Nitric Oxide Abatement in Heavy Duty Gas Turbine Combustors by Means of Aerodynamics and Water Injection" 72–GT–53, American Society of Mecanical Engineers, Mar. 26, 1972.

Borden to Nolan, letter dated Sep. 22, 1992; Subject: "Proposal to Reduce NOx".

CPP Engineers & Constructors to Power Tech Associates, Purchase Order dated Oct. 1, 1992.

DeCorco to Nolan, letter dated Nov. 30, 1992 Submitting Report TR–1032 dated Nov. 30, 1992.

Power Tech Associates, Inc technical report TR–1032, dated Nov. 30, 1992; NOx Reduction Program for W–25–IAA Gas Turbine.

DeCorso to Nolan; letter dated Feb. 10, 1993; Subject: "NOx reduction combustor configurations".

Scheirer to Nolan; letter dated May 26, 1993; Subject: "Technical Report TR–1038".

Power Tech Associates Inc Technical Report T–1038, May 24, 1993 "NOx Reduction Program For CPP Brush Cogen Facility W25IAA Gas Turbines".

Scheirer to Landis, Dec. 13, 1994, Facsimile Transmission.

* cited by examiner

*Primary Examiner*—Charles G. Freay
(74) *Attorney, Agent, or Firm*—William H. Eilberg

(57) ABSTRACT

A combustor liner and a method for combusting fuel in air with lowered production of NOX in a stationary, industrial gas turbine. The liner comprises a fuel injection location within the liner at an upstream end of the liner; combustion air openings in a liner wall sized to admit from about 10% to about 25% of total mass airflow entering the liner; suppression air openings in the liner wall from about 0.3 to about 0.5 equivalent diameters downstream of the combustion air openings, the suppression air openings being sized to admit from about 0.8 to about 4 times the mass airflow entering the liner through the combustion air openings; and wall cooling openings distributed in the liner wall for cooling thereof, the wall cooling openings being sized to admit from about 10% to about 40% of the total mass airflow entering the liner.

4 Claims, 1 Drawing Sheet

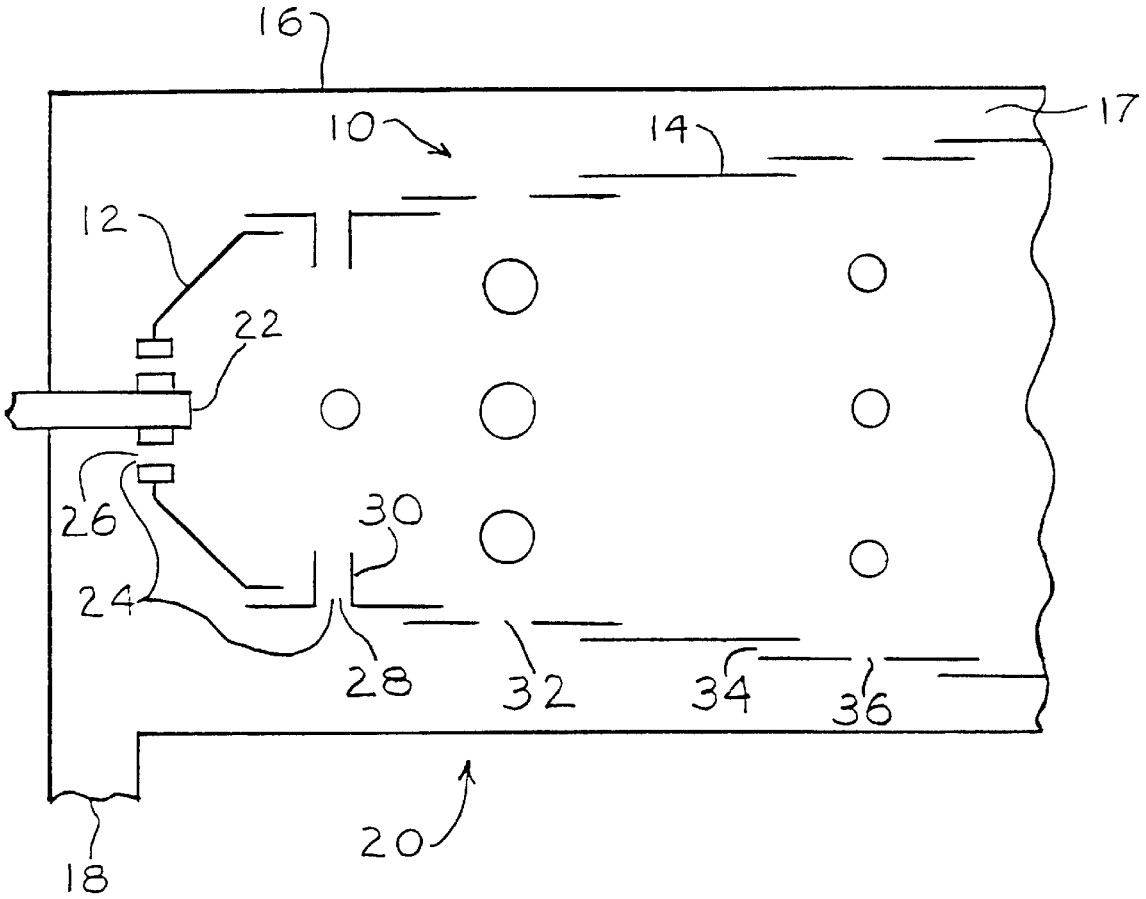
16
10
14
17
12
22
26
30
24
28
32
34
36
20
18

LOW NOX GAS TURBINE COMBUSTOR LINER

This is a division of U.S. patent application Ser. No. 08/491,039, filed Jun. 16, 1995 now abandoned.

TECHNICAL FIELD

This invention relates to stationary, industrial, gas turbines, more specifically to an improved combustor liner for stationary, industrial gas turbines to reduce pollutant generation.

BACKGROUND

Many large producers and industrial users of electric and other forms of power, such as public utility companies and other corporations, in past years, installed large stationary, industrial gas turbines for incremental, peak, and emergency power production. At the time of installation, those industrial gas turbines were capable of operation at acceptable levels of pollutant generation.

For a number of years, the demand for power remained at a constant level, and these gas turbines were operated as intended, typically for one or two hours per day. However, increasingly stringent regulatory controls were imposed on the industrial generation of pollutants such as NO and $NO_2$ (NOX). Nevertheless, operation of the older gas turbines for one or two hours per day was still tolerable because their pollution production was a small fraction of the total pollution produced in all power generating operations. During this period of time, very little new power generation capacity was installed because the demand for power did not increase. However, a significant rise in power demand has been experienced recently, and the supply from available steady generation machinery has been exceeded. Operation of the older gas turbines for longer periods of time is desired to supplement the existing steady power generation capacity. However, operation of the older gas turbines for longer periods at their formerly acceptable levels of pollutant generation is not now acceptable for both for regulatory reasons and negative environmental impact.

Replacement of these older gas turbine installations with new installations designed specifically for operation with lower pollutant production is unattractive because of the high initial cost of the newer machines. While the pollutant production of the older gas turbines may be reduced by installing and using water and/or steam injection, this involves additional investment, higher operating cost, added complexity, and greater maintenance. Other design modifications proposed to achieve lower pollutant generation are even more costly and unattractive. What is needed is an inexpensive modification for these existing industrial gas turbines which will reduce their pollutant production without increasing operating cost.

SUMMARY

This invention satisfies the above needs. The invention provides a novel liner for stationary, industrial gas turbine combustors. An existing liner may be readily reworked to include the novel features. The novel liner comprises an upstream end, a wall extending downstream from the upstream end, a fuel injection location within the liner at the upstream end of the liner, and combustion air openings in the liner wall sized to admit from about 10% to about 25% of the total mass airflow entering the liner. The combustion air openings preferably are located not more than about 0.5 equivalent diameters downstream of the fuel injection location. The combustion air openings may include swirler openings located to admit airflow around the fuel injection location, and penetration air openings located from about 0.4 to about 0.5 equivalent diameters downstream of the fuel injection location. The liner further comprises suppression air openings in the liner wall from about 0.3 to about 0.5 equivalent diameters downstream of combustion air openings located furthest downstream, which usually are the penetration air openings. The suppression air openings are sized to admit from about 0.8 to about 4 times the mass airflow entering the liner through all of the combustion air openings. The liner further comprises wall air openings distributed in the liner wall for cooling the wall and sized to admit from about 10% to about 40% of the total mass airflow entering the liner.

A preferred embodiment of the novel liner further comprises profile air openings in the liner wall located downstream of the suppression air openings and sized to admit from about 10% to about 20% of the total mass airflow entering the liner. Preferably the profile air openings are from about 0.9 to about 1.5 equivalent diameters downstream of the suppression air openings.

THE DRAWING

These and other features, aspects and advantages of the present invention will become better understood with reference to the following description, appended claims and accompanying drawing which is a longitudinal section of a gas turbine combustor liner embodying features of the present invention.

DESCRIPTION

The present invention is directed to a combustor liner for combusting fuel in air in an industrial, stationary gas turbine. With reference to the drawing, a liner 10 according to the present invention encloses an elongated space of finite length for combusting a fuel stream in air streams flowing within and along the length of the liner. Thus, the liner has an upstream end 12 and a wall 14 extending downstream from the upstream end. The liner may be configured as a straight cylinder, or as a curving or spiraling cylinder (not shown), or as a longitudinally extended annular shell (not shown), or as a folded channel of some selected or variable cross section (not shown). Thus the overall direction of flow of gases within the liner may be axial with respect to a longitudinal axis of the liner, or reverse, or spiralling. Typically the liner 10 is contained within a combustor housing 16 with space 17 provided between the housing and the liner. Into this space, through a housing inlet 18, flows compressed air, portions of which enter the liner through various openings in the liner wall. The liner has a downstream end (not shown) which typically leads to a turbine housing enclosing a turbine wheel which is driven by the hot combustion gases discharging from the liner. Thus, this invention also provides a novel gas turbine combustor 20 wherein the combustor comprises a novel liner 10 as provided by this invention. Typically the liner is fabricated of metal capable of operating at high temperature. Since it is meaningful to designate distances in or along the liner in terms of a generalized or normalized parameter, an equivalent diameter existing at any chosen longitudinal location in the liner is defined as four times the flow area within the liner divided by the wetted perimeter at the chosen longitudinal location.

A fuel injector enters the liner for injecting fuel at a fuel injection location 22 at the upstream end of the liner. The liner has various openings for admitting air into the liner to perform various functions. To admit air to combust with the fuel, the liner has combustion air openings 24. Preferably, slightly more than the stoichiometric amount of air required for complete combustion of the fuel is supplied through the combustion air openings. Thus, typically, the combustion air openings are sized to admit from about 10% to about 25% of the total air admitted into the liner. According to this invention, the combustion air openings are preferably located not more than about 0.5 equivalent diameters downstream of the fuel injection location resulting in advantages that will be apparent later.

One form of combustion air openings 24 which the liner may have are swirler openings 26 which are located at the upstream end of the liner and admit air into the liner with swirling motion around the fuel injection location. The swirling motion participates in spreading the injected fuel and in mixing air with the fuel. Downstream of the nozzle, the swirling flow turns 180° thereby recirculating hot gas to the fresh fuel emerging from the nozzle and continuously igniting the fuel.

Another form of combustion air openings 24 which the liner may have are penetration air openings 28 in the liner wall which admit air to penetrate into, mix with the flow within the liner and combust with the injected fuel. Thus, preferably, the penetration air openings 28 are arranged to admit airflow portions oriented to impinge each other within the liner, that is, the openings are preferably diametrically opposite each other. Short tube segments 30, known as scoops, may extend from the penetration air openings inwardly into the liner in order to promote the penetration of the airflow portions from these openings into the flow within the liner. Since the swirler openings 26 and the penetration air openings 28 supply approximately a stoichiometric amount of air for combustion of the fuel, they are collectively termed combustion air openings 24.

About 0.3 to about 0.5 equivalent diameters along the wall of the liner downstream from the furthest-downstream combustion air openings 24, which usually are the penetration air openings 28, are suppression air openings 32 sized to admit from about 0.8 to about 4 times the mass airflow entering the liner through all the combustion air openings 24. Preferably the suppression air openings are spaced approximately about a single plane normal to the overall direction of flow of the hot gases in the liner. The suppression air openings are intended to introduce air into the hot gases flowing in the liner at a selected location along the length of the liner so as to accelerate and chill the hot gas flow to a reduced temperature where NOX does not form at an appreciable rate. The reduced temperature is however not so low as to prevent the continued combustion of uncombusted fuel from proceeding at an appreciable rate. Introducing suppression air takes advantage of the fact that the formation of NOX from oxygen and nitrogen occurs at an appreciable rate only at very high temperatures, and that combustion can occur at appreciable rates at temperatures lower than those at which the formation of NOX from oxygen and nitrogen in the combustion air is suppressed. The location along the liner length for the suppression air openings is selected so that upstream of these openings continuous reignition occurs, there is time for an appreciable initial combustion of the fuel, and only a limited amount of NOX is formed at the high temperatures produced by the initial combustion before the temperature of the gas flow is reduced to suppress the formation of NOX.

The airflow admitted through the suppression air openings is selected to be large enough to produce an effective reduction in temperature of the hot combustion gas flow. The airflow admitted through the suppression air openings is also selected to be small enough so that the suppression airflow will join and flow downstream with the combustion gas flow, that is, the amount of suppression airflow and the manner of its introduction is selected so that its momentum does not overcome the momentum of the combustion gas flowing downstream and does not allow a portion of the suppression airflow to turn and flow upstream. Momentum analysis has shown that when substantially all of the combustion airflow introduced into the liner is admitted through penetration air openings, the mass airflow admitted through the suppression air openings can range up to about 1.33 times the mass airflow admitted through the combustion air openings before an upstream component is developed by the suppression air. Momentum analysis has also shown that when substantially all of the combustion air introduced is admitted through swirler openings, that is, introduced with a predominant downstream momentum, the mass airflow admitted through the suppression air openings can range up to about 6.67 times the mass airflow admitted through the swirler openings before an upstream component is developed by the suppression air. For intermediate cases, the mass airflow admitted through the suppression air openings before an upstream component is developed by the suppression air will be intermediate these extremes.

Without wishing to be held to the following explanation for the reduced formation of NOX resulting from the above-described novel procedure, it is believed that on a microscopic scale turbulent mixing of the injected fuel with the admitted combustion air produces a large number of globules composed, on average, of approximately a stoichiometric mixture of fuel and air. Upon the formation of the globules, the combustion reaction proceeds within the globules very rapidly, almost instantaneously, heating the globules to a high temperature at which nitrogen and oxygen begin to react at an appreciable rate to form NOX. The amount of NOX formed increases with increased time spent by the globules at high temperature. The introduction of suppression air soon after the globules are formed chills the globules to a temperature at which the reaction rate for the formation of NOX is inappreciable and before the amount of NOX formed has been appreciable. The chilling suppression air is introduced with limited radial penetration into the liner so as to chill globules near the liner wall as well as globules near the liner center. The limited penetration is important because more globules are nearer the liner wall than the center of the liner inasmuch as the liner cross sectional area increases with distance from the center. The chilling suppression air is also introduced so as to maintain and increase the velocity of flow of globules downstream and away from the high temperature combustion region of the liner. The NOX reduction will be greater the greater the quantity of chilling suppression air introduced, up to the point when the suppression air is able to overcome the downstream momentum of the combustion air in the liner and split into a branch or component that will travel upstream. Then the accelerating and chilling effect on the high temperature globules will be diminished. Thus the amount of chilling suppression air admitted in this invention is not so large as to overcome the downstream momentum of the globules and produce an upstream portion of flow.

The combustion reaction and the hot gases generated within the liner subject portions of the liner to high rates of heating to high temperatures. To maintain the liner wall at tolerable temperatures, the liner usually has wall cooling openings 34 for cooling by air induced through the openings into the liner interior. Preferably, the quantity of cooling air introduced is adjusted along the liner to correspond to the temperature of the combustion gases and the degree of heating. Any configuration of wall cooling opening may be used. Configurations known in the art include splash rings, wiggle strips, thumbnail louvers, effusion openings, and double-wall forced convective openings. However, it is even possible to avoid cooling air openings by fabricating the liner of material capable of withstanding temperatures developed in the combustion process, such as ceramic material.

As stated earlier, the combustion air openings 24 are preferably located not more than about 0.5 equivalent diameters downstream of the fuel injection location 22. Also the suppression air openings 32 are preferably from about 0.3 to about 0.5 equivalent diameters downstream of the furthest-downstream combustion air openings 24, which usually are penetration air openings 28. This preferred arrangement provides a configuration where the combustion is predominantly conducted early, in the upstream portions of the liner, and the resulting very hot combustion gas flow is chilled early by the suppression air. Thus less cooling, and, consequently, less air for cooling of the downstream portions of the liner wall is required. This is a significant advantage over prior-art liners. The reduced downstream cooling air requirement makes more air available for use as suppression air. In the liner provided by this invention, the wall cooling openings may be sized to admit from about 10 to about 40% of the total airflow admitted into the liner. Preferably, however, the wall cooling openings are sized to admit from about 10 to about 30% of the total airflow admitted into the liner.

Downstream of the suppression air openings 32, the liner preferably has profile air openings 36 to admit air flow to adjust the temperature profile of the gas flow discharging from the liner and entering the turbine. It is possible thereby to eliminate a hot zone or high temperature peak in the profile thereby avoiding premature burnout in the turbine and extending the operating life of the turbine. With the profile air openings it is also possible to adjust the temperature profile of the gas flow to have its lowest temperatures at the turbine blade hubs where centrifugal stress in the blades is highest, thereby allowing the blade metal at the hub to operate at lower temperatures and at higher stresses. Preferably the profile air openings are sized to admit from about 10 to about 20% of the total airflow admitted to the liner. Preferably the profile air openings are located from about 0.9 to about 1.5 equivalent diameters downstream of the suppression air openings.

In one embodiment of the invention, the combustion air admitted into the liner is predominantly admitted through the swirler air openings. In this embodiment the swirler openings 26 admit from about 10 to about 25% of the total air admitted into the liner, and the penetration air openings 28 may admit up to 15%. In this liner, the suppression air openings preferably admit from about 1 to about 2 times the mass airflow admitted through the combustion air openings, that is, through the swirler air openings and the penetration air openings.

In another embodiment of the invention, the penetration air openings 28 are sized to admit from about 20 to 25% of the total airflow admitted into the liner and the swirler openings 26 are sized to admit up to 12% of the total airflow admitted into the liner. Thus combustion air is predominantly admitted by the penetration air openings. In this liner, the suppression air openings may admit from about 0.8 to about 1.1 times the airflow admitted through the combustion air openings, that is, through the penetration air openings and the swirler openings. Preferably, in this liner, the suppression air openings admit from about 0.9 to about 1.1 times the airflow admitted through the combustion air openings.

EXAMPLE

A number of liners embodying this invention were experimentally evaluated by measuring the NOX produced in a gas turbine incorporating its prior-art liner and comparing with the NOX produced in the gas turbine operating at comparable conditions and incorporating a liner configured according to this invention. The gas turbine incorporating its prior-art liner typically produced 90 ppmv of NOX when fired with natural gas and 155 ppmv of NOX when fired with No. 2 oil. Results are tabulated below. Air flow quantities are in terms of mass.

| Liner No. | Suppression Air % of total | Suppression Air / Combustion Air | NOX Reduction % |
|---|---|---|---|
| 1 | 10.5 | 0.454 | 0 |
| 2 | 17.5 | 1.613 | 22 |
| 3 | 22 | 0.756 | 24 |
| 4 | 24 | 0.667 | 26 |
| 5 | 30.5 | 0.980 | 40 |
| 6 | 35 | 1.020 | 36 |
| 7 | 37.5 | 0.694 | 22 |
| 8 | 38 | 1.316 | 24.5 |

In Liners Nos. 1–2 and 5–8 substantially all of the combustion air was introduced through penetration air openings. In Liners Nos. 3 and 4, swirler air admitted was about 20% of total mass airflow admitted into the liner, and thus most of the combustion air was introduced through swirler openings. It is seen that NOX reduction increased with increasing quantities of suppression air admitted until the suppression air reached about 30.5% of the total mass airflow admitted into the liner. This corresponded to a suppression air to combustion air ratio of about 0.98. After this point, as the suppression air quantity was increased, the NOX produced began to increase. It is believed that the reversal of the NOX reduction resulted from the development of an upstream component by the suppression air admitted. In such a liner, had a greater proportion of combustion air been introduced through the swirler openings, the forward momentum of the combustion air would have been greater, and a greater amount of suppression air could have been introduced before an upstream component in the suppression air would have developed, whereby a further reduction in NOX concentration could have been achieved. It is seen that NOX reductions of 40% compared to prior-art liners have been achieved by this invention. Further reductions are possible by using water or steam injection in a gas turbine incorporating a liner embodying this invention.

This invention also provides a method of combusting fuel in air with lowered production of NOX in a stationary, industrial gas turbine. The method comprises:

(a) enclosing an elongated space for combustion within a combustor liner having an upstream end and a wall extending downstream from the upstream end;

(b) introducing fuel at a fuel injection location within the liner at the upstream end of the liner for flow downstream within the liner;

(c) admitting through combustion air openings in the liner from about 10% to about 25% of total mass airflow entering the liner;

(d) admitting through suppression air openings in the liner located from about 0.3 to about 0.5 equivalent diameters downstream of combustion air openings located furthest downstream, from about 0.8 to about 4 times mass airflow entering the liner through the combustion air openings; and (e) admitting through wall cooling openings distributed in the liner wall for cooling thereof from about 10% to about 40% of total mass airflow entering the liner.

The combustion air openings are preferably located not more than 0.5 equivalent diameters downstream of the fuel injection location. A preferred method further comprises admitting through profile air openings in the liner downstream of the suppression air openings, from about 10% to about 20% of total mass airflow entering the liner.

The foregoing embodiments and examples are to be considered illustrative, rather than restrictive of the invention, and those modifications which come within the meaning and range of equivalence of the claims are to be included therein.

What is claimed is:

1. A method of designing a combustor liner for combusting fuel in air with lowered production of NOX in a stationary, industrial gas turbine, the combustor liner having an upstream end and a wall extending downstream from said upstream end, and a fuel injection location within said liner at said upstream end of said liner, the method comprising:

a) forming penetration air openings, in said liner wall, at a position which is spaced apart from, and downstream of, said fuel injection location, and sizing the penetration air openings such that substantially all combustion airflow introduced into the liner is admitted through the penetration air openings, b) determining sizes of a plurality of suppression air openings to be formed in said liner wall at a position which is spaced apart from, and downstream from, said penetration air openings, such that the suppression air openings are large enough to produce an effective reduction in temperature of hot combustion gas so as to reduce formation of NOX, and small enough so as not to create an upstream flow of suppression air, and c) forming said suppression air openings in said liner wall, wherein step (b) includes sizing the suppression air openings such that a mass airflow admitted through the suppression air openings is not more than about 1.33 times a mass airflow admitted through the penetration air openings.

2. The method of claim 1, wherein step (c) includes positioning said suppression air openings from about 0.3 to about 0.5 equivalent diameters downstream of the penetration air openings, wherein an equivalent diameter at a given location is defined as four times a flow area within the liner divided by a wetted perimeter at said given location.

3. The method of claim 2, further comprising forming cooling openings in the liner, and sizing the cooling openings such that about 10–40% of a total airflow admitted into the liner flows into the cooling openings.

4. The method of claim 3, further comprising forming profile air openings in the liner, downstream of the suppression air openings, and sizing the profile air openings such that about 10–20% of a total airflow admitted into the liner flows into the profile air openings.

* * * * *